US006013010A

United States Patent [19]

Farsaie

[11] Patent Number: 6,013,010

[45] Date of Patent: Jan. 11, 2000

[54] PORTABLE EXERCISE DEVICE

[76] Inventor: Reza Farsaie, 6254 Kester Ave., Van nuys, Calif. 91411

[21] Appl. No.: 09/111,246

[22] Filed: Jul. 3, 1998

[51] Int. Cl.[7] ..... A63B 21/012; A63B 23/10; A63B 23/14

[52] U.S. Cl. ..... 482/46; 482/79; 482/118; 482/132

[58] Field of Search ..... 482/44–46, 79, 482/95, 96, 115, 117, 118, 131, 132, 127, 139, 141, 908, 148; 601/131

[56] References Cited

U.S. PATENT DOCUMENTS

| | | | |
|---|---|---|---|
| 1,824,920 | 9/1931 | Novak | 482/132 |
| 2,921,791 | 1/1960 | Berne | 482/118 |
| 3,672,670 | 6/1972 | Burzenski | 482/132 |
| 4,108,429 | 8/1978 | Minichiello | 482/127 |
| 4,203,591 | 5/1980 | Gibson | 482/46 |
| 4,557,479 | 12/1985 | Guibert | 482/44 |
| 5,167,596 | 12/1992 | Ferber | 482/46 |
| 5,507,712 | 4/1996 | Chang | 482/127 |
| 5,536,223 | 7/1996 | Ferber | 482/46 |

*Primary Examiner*—Richard J. Apley
*Assistant Examiner*—Victor Hwang

[57] ABSTRACT

An exercise device retractable, compact, and portable comprised of a main center piece block assembly, with two aligned handles with adjustable tension control. The center piece block assembly on one of the two surfaces has a multitude of spherical ball rollers to allow rotatability to every desired direction with a minimum friction or resistance. The opposite side of the center piece block provides a mild recessed surface corresponding to foot heel impression to allow stability for the footrest zone during user exercising. The handgrips of the device in this invention offers torsion control of either the same or the opposite direction of rotation during wrist exercise.

17 Claims, 5 Drawing Sheets

PORTABLE EXERCISE DEVICE

BACKGROUND—FIELD OF INVENTION

This invention has been filed in the PTO, as a disclosure document No. 436352 dated May 18, 1998.

The invention relates generally to the field of exercise devices for the wrist and arm, and upper and lower body.

DESCRIPTION OF ART

It is well understood that for the exercise of the upper body particularly, wrists, arms, shoulders, and chest and back, athletes utilize many exercise devices in gyms or at home which are for a specific part, and are large in size and require a certain place or environment for performing athletic endeavor.

It would be the ultimate desire to combine many aspects of these modern exercise machines into one light, compact, and portable device that could be carried around in a purse or briefcase and be accessible during traveling or at work site, or in the privacy of a person's chosen location.

There are numerous patents in the prior art; each dedicated for specific part of the body exercise while exerting certain resistance force.

The present invention does not induce any reactive force, but facilitates support for unlimited body movement patterns, ranging from light to severe.

SUMMARY OF THE INVENTION

It is the object of this invention to be compact and portable, by means of retracting parts, and have features to be utilized for general purpose exercise, and to be manufactured with the least amount of material and cost, and thus be affordable for everyone.

The extendible handgrips offer support for the arms for a desired upper body floatation movements on the floor or on the wall.

The exercise can be conducted with this invention as a circular or the linear, twisting or stretching motion of the upper body. The wrist-exercising feature is simple, and can be conducted with wrist rotating relative to one another or against one another, one hand exercise or both. The device of this invention consists of a center block part that may be laid on the floor or wall and the handles that support the partial weight of the body. Several individual low friction spherical rollers which are captured in a housing and float over a row of internal ball rollers, come in contact with the floor surface, and provide a support for all the intended body movements to any desired direction.

The center-piece, if used in an inverted position, can also serve to massage the bottom of the feet when it comes in contact with the spherical rollers. The center-piece if used in an inverted position can also be used as a leg exercise device by placing the bottom of foot heel in the foot impression cavity provided in the bottom plate of the device to facilitate a grip for wide range of leg movements.

REFERENCE NUMERALS IN DRAWINGS

3=Key way washer
4=Key way
6=Washer
8=Wavy lock washer
10=Stud bolt thread
11=Foot heel indentation
12=Shoulder bolt hole
14=Latch pin housing
16=Stud bolt hole
17=Handle shaft
18=Latch pin stud receiving cavity
20=Upper plate of the main body
21=Lower plate of the main body
22=Spherical roller
23=Spherical roller of smaller size
24=Base assembly of handle "R"
25=Hand grip tubing "R"
26=Hand grip tubing "L"
27=Base assembly "L"
32=Stud pin latching pin
33=Push button housing
35=Shoulder bolt
36=Latching spring
38=Flat spring
39=Push button pivoting pin
44=Latch push button
45=Knurled tension adjusting nut

DESCRIPTION OF THE PREFERRED EMBODIMENT

Figure 1:
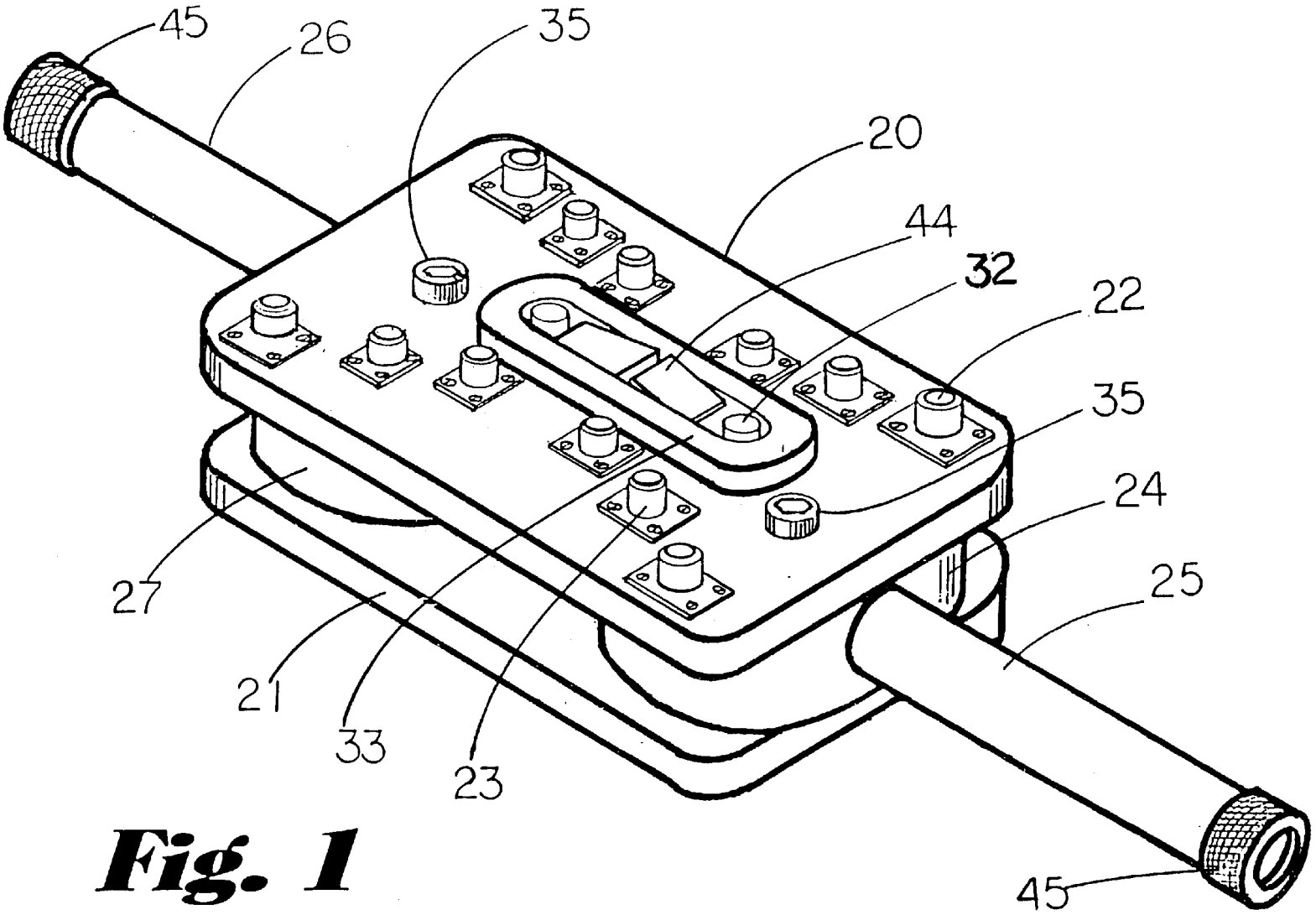
FIG. 1 Depicts a perspective drawing of this invention, with the handles in extended position.

An exercise device in for the upper body in FiG. 1, comprises of a main center piece 20 a rectangular upper block with rounded edges, and a second block 21 identical in size and shape, and a pair of rotatable hand grip mechanisms 25 and 26 situated on the two opposite sides of the said center piece block.

Figure 2:
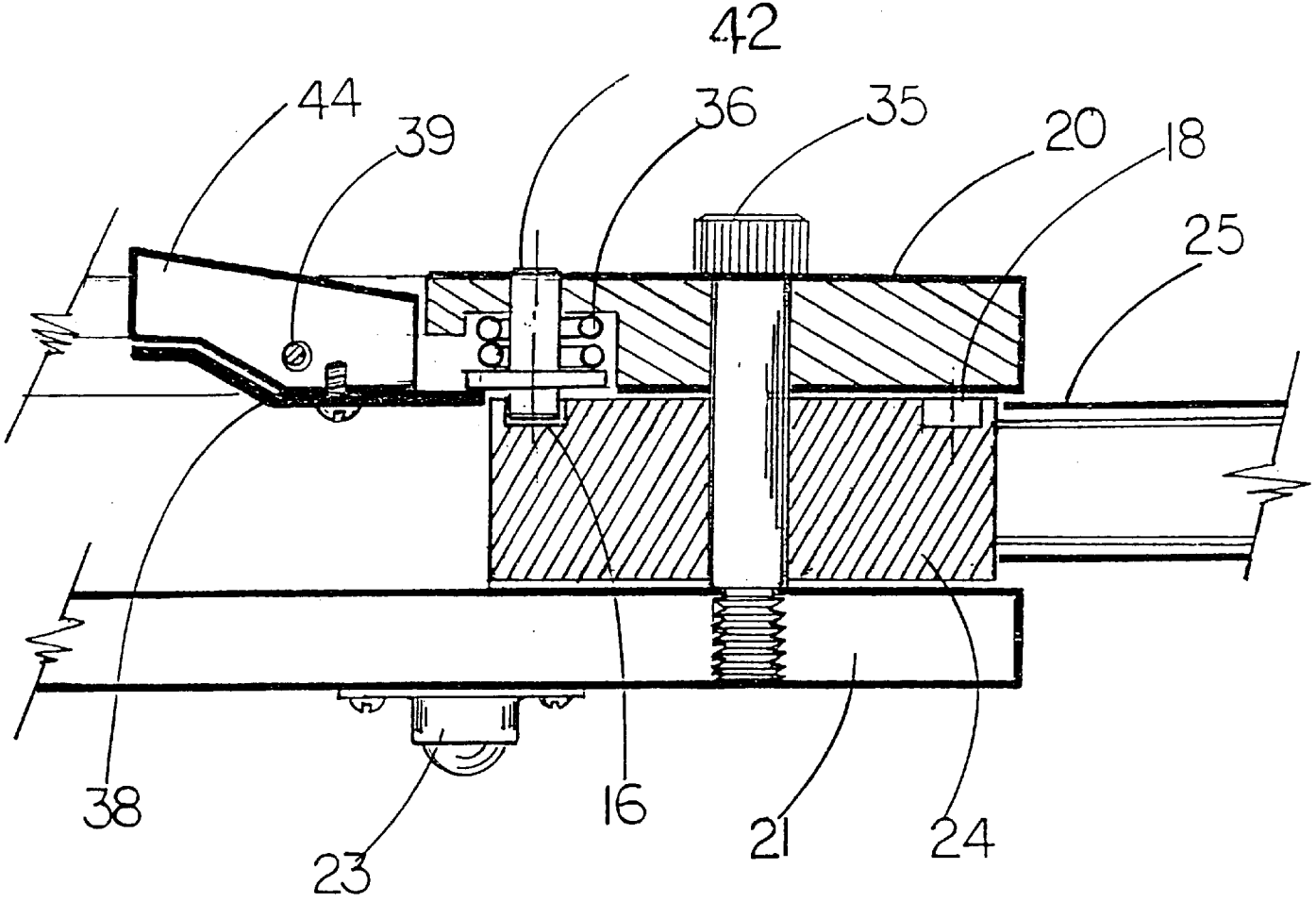
FIG. 2 Detail of the retractable handle release push button mechanism in cross sectional view.

The hand grip mechanisms 25 and 26 in FIG. 2 are connected, to individual circular blocks on each side, and the circular blocks 24 and 27 have the capability of pivoting around their individual axis 180 degrees. The main purpose of this revolving feature is to facilitate latch lock in two positions; either for stowing away purpose thus providing compactness and portability, or secondly providing safe and secure position for the in use mode during exercise.

Figure 3:
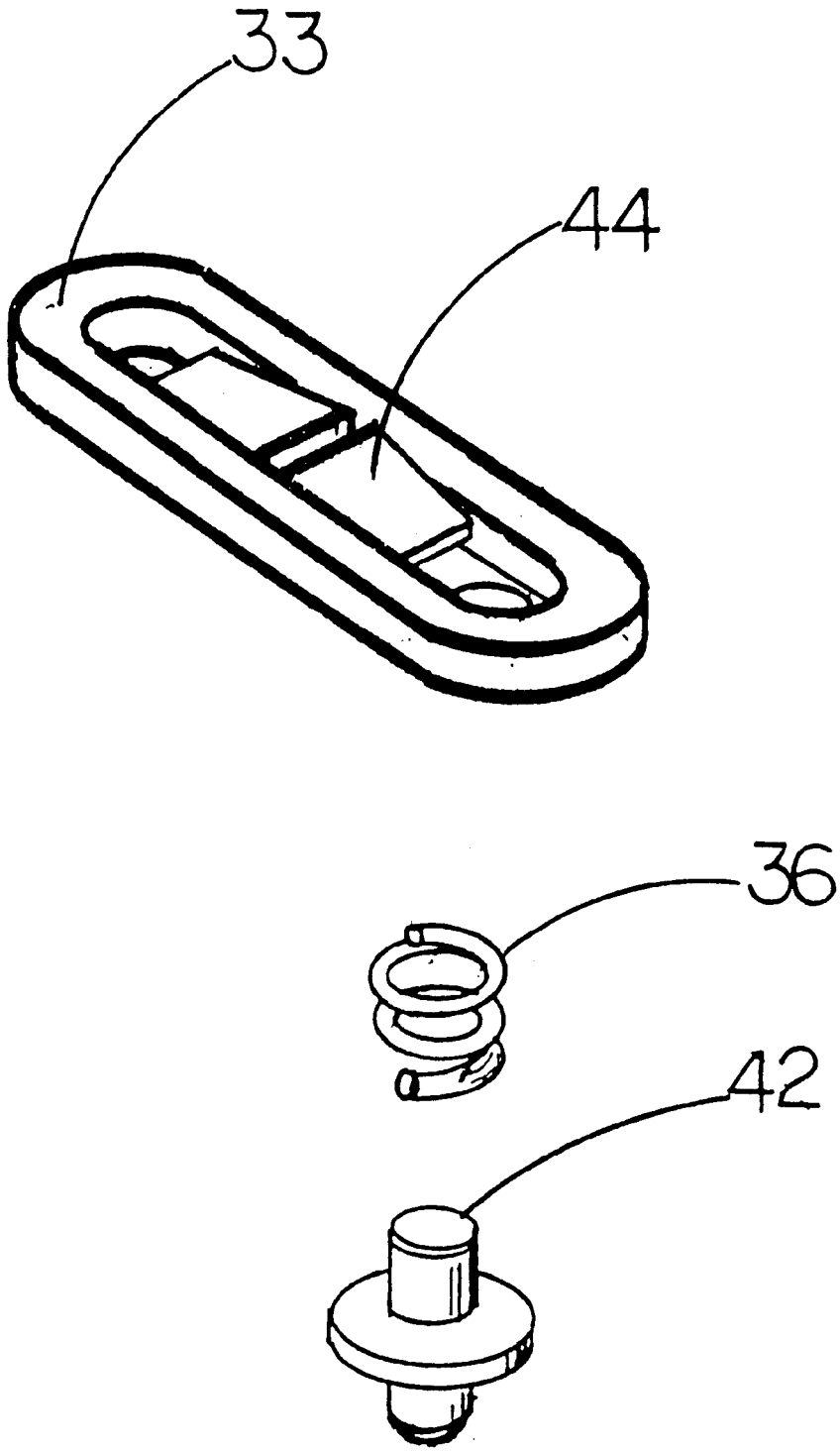
FIG. 3 Detail of the locking mechanism of the retractable handle.
Figure 4:
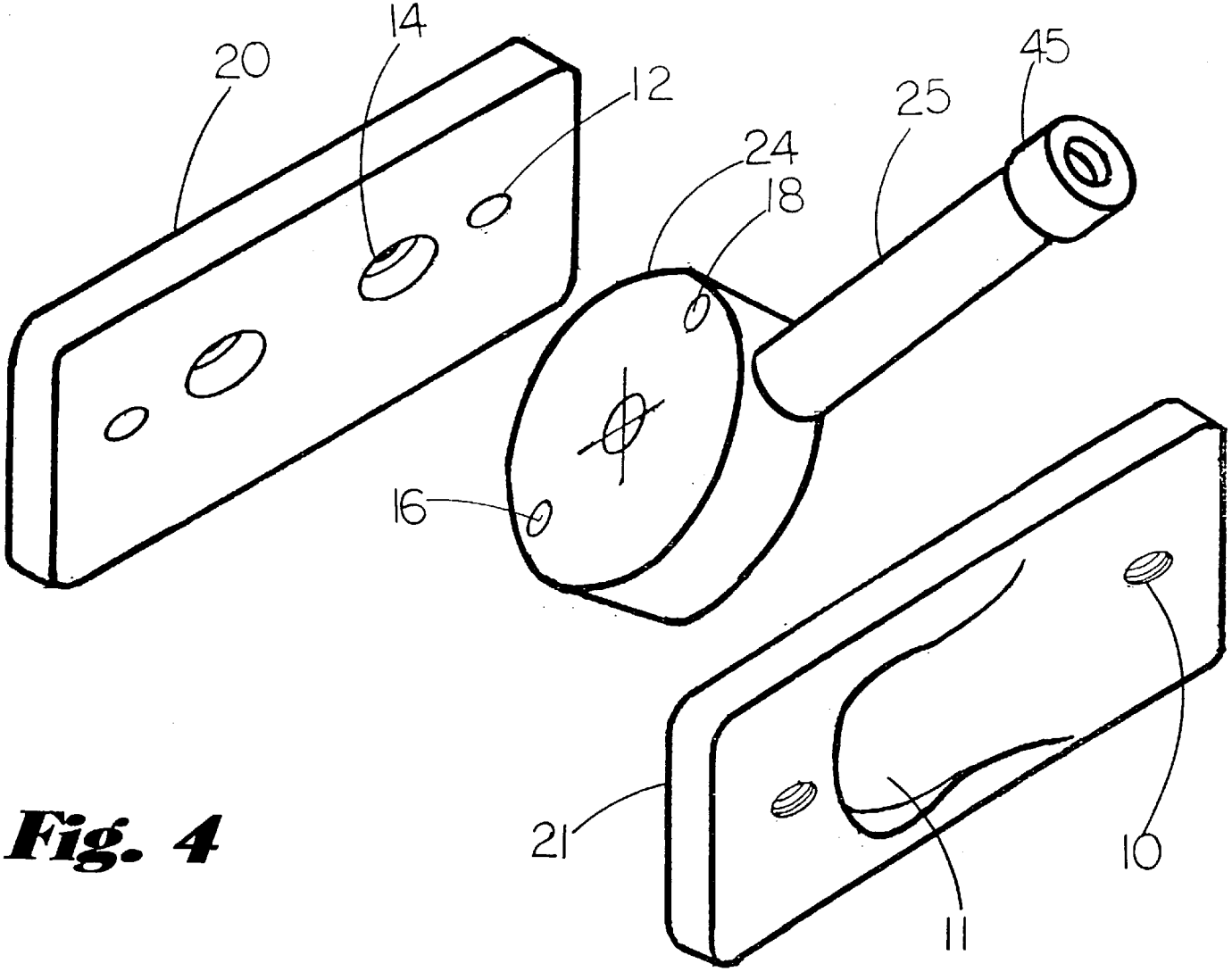
FIG. 4 Isometric view of the top and bottom plate and the one of the handles of the main body of the device, with bottom plate showing the foot heel placement indentation.

To the top block 20, a plurality of spherical rollers 22 with minimized friction are attached. Four of the spherical rollers situated at four comers are of the same size, whereas the other spherical rollers 23 may be slightly smaller in size. The exercise device in FIG. 1 may be used as a feet rubbing and massaging device, when a bare foot comes in contact with the spherical rollers. To the upper block 20 at the center is attached the latch releasing mechanism 33, as shown in FIG. 1 and FIG. 3 with handle grip latch release button 44. For the sake of simplicity, only one of the handles and the latching mechanisms will be described in detail as shown in FIG. 2, FIG. 4, and FIG. 5, whereas the other handle, and it's mechanism is symmetrically the same.

In FIG. 3 the top plate 20 provides the housing seat for the pin mechanism 32 which is spring loaded with downward pressure by the coil spring 36 on the upper portion FIG. 2, and FIG. 3. Thus whenever the handle grip base block 24,is being revolved with its receiver cavity 18 aligned with the lower stud of the pin 32 it will click to insert inside the said cavity, thus providing a secured latching. Obviously another such receiving cavity 16 approximately 170 degrees apart provide the latching for the retracted mode of the handle.

The latch rocker push button 44 in FIG. 2 carries a flat spring 38 at the bottom that one end of it is extended and is in contact with the lower rim surface of the stud pin 42. When the release rocker push button is depressed the latch pin 32 will compress the coil spring 36 and forces the pin 32 out of the hand grip base block's cavity 16, thus allowing for the hand grip to rotate and align with the next bored cavity approximately 170 degrees from the first bored cavity for the new latching engagement.

Figure 5:
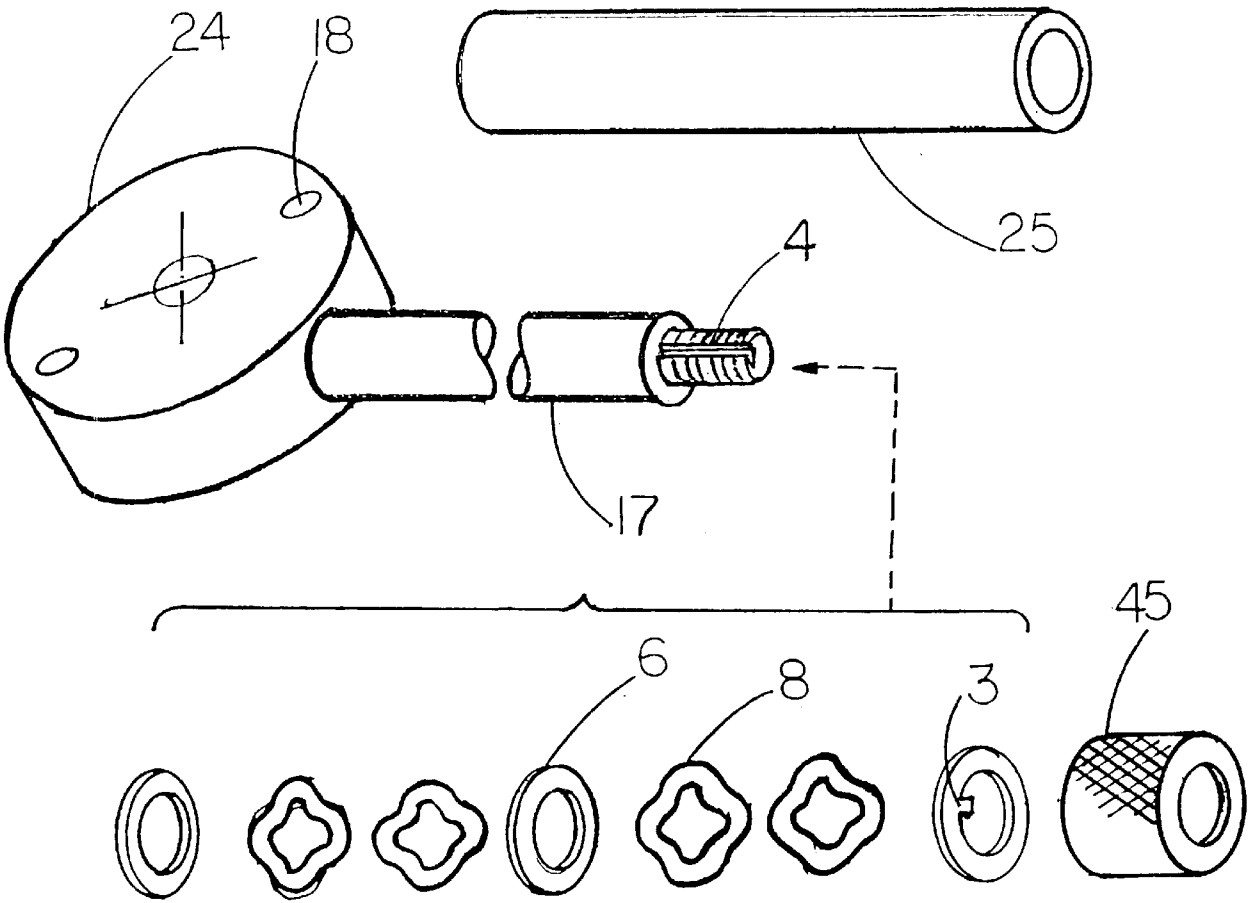
FIG. 5 reveals the main structure of the handle mechanism with tension adjustment components.

The hand grip mechanism 25 in FIG. 5 is comprised of the shaft 17 and revolving base block 24. The hand grip shaft is machined at one end to provide a shoulder at the open end and is threaded and has a key way 4. The hand grip tube 25 is inserted over hand grip shaft 17, then a successive series of duplicate flat washer 6, two wavy lock washers 8 and another flat washer 3 with tongue to ride inside the key way of the shaft handle are pushed against the hand grip tube 25 with torsion resistance adjustment nut 45. Increase in tightening of the knurled nut 45 will result in torsion resistance of the hand grip tube during wrist exercise and vice versa.

In the normal operation, the lower block 21 is faced up and the upper block 20 bearing the assembly of the spherical rollers is in contact with the floor or wall surface, whichever the intended exercise case may be.

The lower block 21 bears a recessed surface area resembling the foot heel impression in order to capture the foot heel during the linear or circular motion of the foot exercise. The threaded hole 10 will receive the shoulder bolt 35 to complete the assembly of the upper and lower plates 20 and 21 and the handle base component 24.

I claim:

1. A compact, portable and retractable exercising device comprising:

a main body having an upper plate and a lower plate;

a pair of handgrip assemblies, each handgrip assembly pivotally mounted between the upper and lower plates so as to be retractable to a stowed position and extendable to a useable position;

a latching mechanism for selectively locking each handgrip assembly in its respective stowed, retracted position or in its useable, extended position;

each handgrip assembly further including a handgrip rotatably mounted thereto and a torsional resistance mechanism for resisting the rotational movement of said handgrip relative to said handgrip assembly; and a plurality of rollers mounted to said main body, wherein a user may exercise their body by movement of the handgrips against the resistance provided by the torsional resistance mechanism, the user may exercise their body by supporting a portion of their body on the main body with the plurality of rollers engaging a support surface and moving the main body and the user's body portion together relative to the support surface, or the user may exercise their body by moving a portion of their body relative to the device while the portion of their body is engaged with the plurality of rollers.

2. The exercise device of claim 1, wherein said torsional resistance mechanism is adjustable in the magnitude of torsional resistance provided to rotational movement of said handgrip relative to said handgrip assembly.

3. The exercise device of claim 2, wherein said torsional resistance mechanism comprises a frictional resistance mechanism.

4. The exercise device of claim 3, wherein said frictional resistance mechanism comprises a series of flat washers and wavy lock washers.

5. The exercise device of claim 1, wherein said plurality of rollers comprises a plurality of spherical rollers.

6. The exercise device of claim 5, wherein said plurality of spherical rollers are mounted to said upper plate.

7. The exercise device of claim 6, wherein said plurality of spherical rollers comprises spherical rollers of a first size mounted to said upper plate adjacent a periphery of said upper plate.

8. The exercise device of claim 7, wherein said plurality of spherical rollers further comprises spherical rollers of a second size smaller than said spherical rollers of said first size, said spherical rollers of said second size mounted on said upper plate further from the periphery of said upper plate than said spherical rollers of said first size.

9. The exercise device of claim 6, wherein said latching mechanism is mounted to said upper plate.

10. The exercise device of claim 6 further comprising a foot support on said lower plate.

11. The exercise device of claim 10, wherein said foot support comprises an indentation on an external surface of said lower plate adapted to receive a portion of a user's foot.

12. The exercise device of claim 1, wherein said latching mechanism comprises at least two spring loaded latching pins secured to said upper plate; and each said handgrip assembly includes a base portion having at least two latch pin cavities for receiving an end of said respective latching pin.

13. The exercise device of claim 12, wherein said latching mechanism further comprises a push button mechanism for selectively disengaging each said latching pin from one of its respective latch pin cavities.

14. The exercise device of claim 1, wherein each said handgrip assembly further comprises a base portion and an handle shaft extending therefrom; said base portion pivotally mounted between said upper and lower plates; and said handgrip rotatably mounted to said handle shaft.

15. The exercise device of claim 14, wherein said torsional resistance mechanism comprises a tension nut threadedly mounted to a threaded distal end of said handle shaft.

16. The exercise device of claim 15, wherein said torsional resistance mechanism further comprises a series of flat washers and wavy lock washers positioned on said threaded distal end of said handle shaft between said rotatably mounted handgrip and said tension nut.

17. A compact, portable and retractable exercising device comprising:

a main body having an upper plate and a lower plate;

a pair of handgrip assemblies, each handgrip assembly comprising a base portion and an handle portion extending therefrom;

each said base portion pivotally mounted between said upper and said lower plates;

each handgrip assembly further including a handgrip rotatably mounted to said handle shaft and a torsional resistance mechanism for resisting the rotational movement of said handgrip relative to said handgrip assembly;

said torsional resistance mechanism comprises a tension nut threadedly mounted to a threaded distal end of said handle shaft and a series of flat washers and wavy lock washers positioned on said threaded distal end of said handle shaft between said rotatably mounted handgrip and said tension nut;

a latching mechanism for selectively locking each handgrip assembly in its respective stowed, retracted position or in its useable, extended position;

said latching mechanism comprises at least two spring loaded latching pins secured to said upper plate and each said base portion having at least two latch pin cavities for receiving an end of said respective latching pin;

said latching mechanism further comprises a push button mechanism for selectively disengaging each said latching pin from one of its respective latch pin cavities;

said lower plate including an indentation adapted to receive a portion of a user's foot; and a plurality of spherical rollers mounted to said upper plate;

said plurality of spherical rollers comprising a plurality of spherical rollers having a first size mounted to said upper plate adjacent a periphery of said upper plate and a plurality of spherical rollers having a second size smaller than said first size mounted to said upper plate further from the periphery of said upper plate than said spherical rollers of said first size, wherein a user may exercise their body by movement of the handgrips against the resistance provided by the torsional resistance mechanism, the user may exercise their body by supporting a portion of their body on the main body with the plurality of rollers engaging a support surface and moving the main body and the user's body portion together relative to the support surface, or the user may exercise their body by moving a portion of their body relative to the device while the portion of their body is engaged with the plurality of rollers.

* * * * *